United States Patent [19]

Imamura et al.

[11] 4,441,412

[45] Apr. 10, 1984

[54] DRIVING DEVICE OF SORTING CYLINDER FOR USE IN A ROTARY TYPE RICE HULLING AND SORTING DEVICE

[75] Inventors: Ryuichi Imamura; Kanzo Shimazaki; Satoru Yahashi; Takashi Yamamoto; Noriyuki Yano, all of Nangoku, Japan

[73] Assignees: Yanma Agricultural Equipment Company Limited, Osaka; Seirei Industry Company Limited, Okayama, both of Japan

[21] Appl. No.: 460,636

[22] Filed: Jan. 24, 1983

[30] Foreign Application Priority Data

Jan. 25, 1982 [JP] Japan ..... 57-8889
Mar. 10, 1982 [JP] Japan ..... 57-34430

[51] Int. Cl.[3] ..... B02B 3/00; B02B 3/04; B02B 7/02

[52] U.S. Cl. ..... 99/601; 99/523; 99/609; 99/618; 99/621; 209/684; 209/687

[58] Field of Search ..... 99/518, 519, 523, 524, 99/600, 601, 609–611, 617, 618, 620–622; 209/136, 137, 684, 687; 241/6, 7, 80, 9–11

[56] References Cited

U.S. PATENT DOCUMENTS

| | | | |
|---|---|---|---|
| 2,182,638 | 12/1939 | Mjolsness | 209/687 |
| 2,672,235 | 3/1954 | Freeman | 209/687 |
| 3,952,645 | 4/1976 | Satake | 99/621 X |
| 4,357,864 | 11/1982 | Salete-Garces | 99/621 X |

*Primary Examiner*—Timothy F. Simone
*Attorney, Agent, or Firm*—Fisher, Christen & Sabol

[57] ABSTRACT

A driving device of sorting cylinders for use in a rotary type rice hulling and sorting device, characterized by comprising a hulling part, a pneumatical sorting part and a rotary type sorting part provided with sorting cylinders rotatably installed therein with one end thereof as the feeding side of rice grains to be sorted and the other end thereof as the discharging side of rice hulled and sorted and having a large number of recesses formed on the internal surface thereof and receiving troughs for taking out the rice grains scooped up by said recesses, said hulling part, said pneumatical sorting part and said rotary type sorting part being integrally constructed and interlocked, and the rotational speed of said sorting cylinders being controllable optionally in no connection with the revolution of said hulling part and said pneumatical sorting part.

3 Claims, 9 Drawing Figures

DRIVING DEVICE OF SORTING CYLINDER FOR USE IN A ROTARY TYPE RICE HULLING AND SORTING DEVICE

BRIEF SUMMARY OF THE INVENTION

The present invention relates to a driving device of sorting cylinders for use in a rotary type rice hulling and sorting device comprising a hulling part, a pneumatical sorting part and a rotary type sorting part provided with sorting cylinders rotatably installed therein with one end thereof as the feeding side of rice grains to be sorted and the other end thereof as the discharging side of rice hulled and sorted and having a large number of recesses formed on the internal surface thereof and receiving troughs for taking out the rice grains scooped up by said recesses, said hulling part, said pneumatical sorting part and said rotary type sorting part being integrally constructed and interlocked.

The shapes and sizes of husks and unhulled rices, which are the grains to be sorted, are dependent upon the kinds of rice plant, cultivation control, weather conditions and the like. According to the present invention, said rotary type sorting part is provided with sorting cylinders rotatably installed therein with one end thereof as the feeding side of rice grains to be sorted (mixture of husks and unhulled-rice grains) and the other end thereof as the discharging side of rice grains hulled and sorted and having a large number of recesses formed on the internal surface thereof and receiving troughs for taking out the rice grains scooped up by said recesses, the rice grains to be sorted being gradually fed to the feeding side to form the fluidized bed layer thereof having a suitable thickness on the internal surface of said sorting cylinders, the grains to be sorted being transferred from the feeding side to the discharging side, the rice grains to be sorted being scooped up by said recesses and hoisted to the upper side during said transference thereof followed by escaping from said recesses and being dropped along a parabola. In this time, the rice grains to be sorted can be divided into husks and unhulled-rice grains owing to the difference in the drop positions thereof, that is to say ones, which are dropped along the larger parabola, can be divided from ones, which are dropped along the smaller parabola. Accordingly, the rice grains having the longer shape easily escape from said recesses after being scooped up by said recesses while those having the shorter shape encounter difficulty escaping from said recesses after being scooped up by said recesses. Also the rice grains to be sorted having the larger grain sizes easily escape from said recesses after being scooped up by said recesses while those having the smaller grain sizes experience difficulty escaping from said recesses after being scooped up by said recesses. Thus the rice grains, which easily escape from said recesses, are dropped along the smaller parabola while those, which have difficulty escaping from said recesses, are dropped along the larger parabola.

Although, according to the present invention, said rotary type sorting part operates on the basis of the above described principle, the shapes and sizes of husks and unhulled-rice grains are dependent upon the kinds of rice plant, cultivation control, weather conditions and the like, as described at the beginning.

Thus it is an object of the present invention to provide a rotary type rice hulling and sorting device in which the rotational speed of sorting cylinders for use in said rotary type rice hulling and sorting device can be optionally controlled without regard to the revolution of said hulling part and said pneumatic sorting part in correspondence to the difference in shapes of husks and unhulled-rice grains and the sizes thereof which are dependent upon the kinds of rice plant and other conditions, thereby said drop positions of husks and unhulled-rice grains being corrected, and as a result said rotary type sorting part being conformed to the above described conditions to always achieve the good sorting function and increase the efficiency.

It is another object of the present invention to provide a rotary type rice hulling and sorting device in which the power is transmitted from a driving shaft, which is rearwardly protruded from a gear box of said hulling part, to an optional driving shaft of said rotary sorting part to improve the transmission efficiency and simplify the structure thereof.

BRIEF DESCRIPTION OF THE DRAWINGS

The annexed drawings show an embodiment of the present invention, wherein.

and

Figure 9:
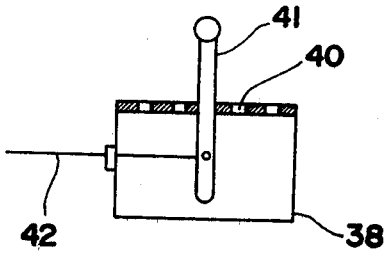
Figure 7:
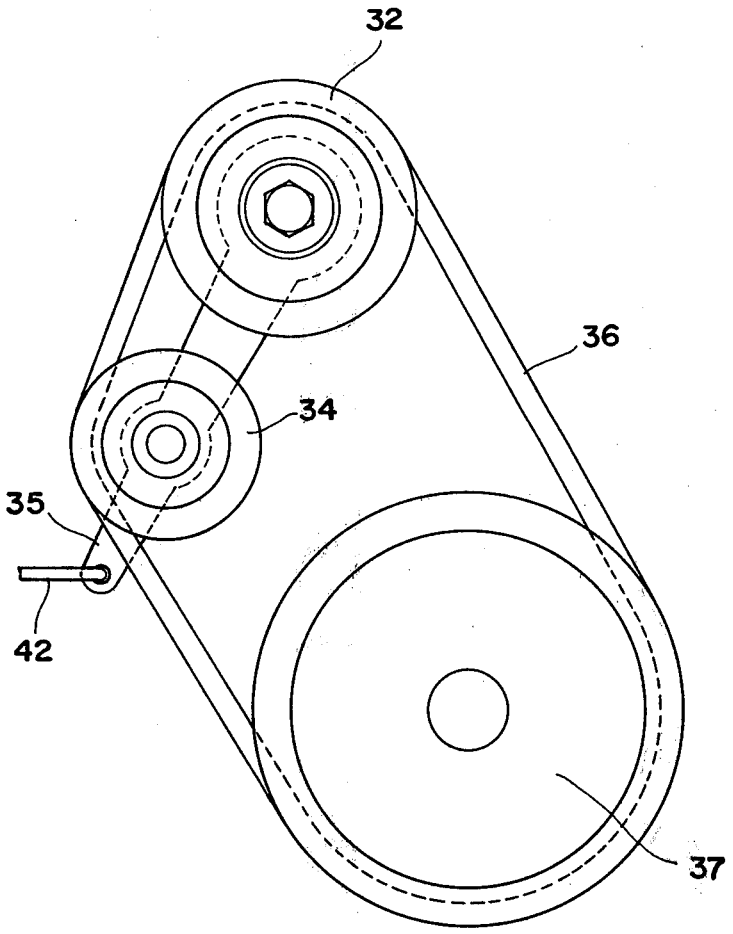
FIG. 7 is a rear view showing of P portion.

FIG. 9 is a side elevation of said Q portion.

DETAILED DESCRIPTION OF A PREFERRED EMBODIMENT

A description of an embodiment of the present invention will be made referring to the drawings.

"A" designates a hulling part including an unhulled-rice tank 1 and a pair of hulling rolls installed therein, "B" designating a pneumatic sorting part composed of a hulled rice-pneumatic sorting part B1 provided with a suction means 3 at the front end thereof to form a suction duct 4 (shown in FIG. 4) and an unhulled-rice-sorting part B2 provided with a pneumatic rice reservoir 5 at the rear end thereof to form a pneumatic duct 6 (shown in FIG. 4) communicated with each other so that suction air and pressurized air of said suction means 3 and said pneumatic rice reservoir 5 may be transferred through said suction duct 4 from a pressurized air duct 6. 7 designates a trough for receiving hulled rice grains, 8 designating a trough for receiving the second grade hulled rice grains, and 9 designating a trough for receiving unhulled-rice grains.

"C" designates a rotary type sorting part comprising a plurality of the primary sorting cylinders "a" and a plurality of the secondary sorting cylinders "b" rotatably installed by means of several rotary wheels 11 and having a large number of recesses 10 formed on the internal surface thereof so that one end side thereof may be the feeding side X and the other end side thereof may be the discharging side Y, said hulling part "A" being mounted on said hulled rice-pneumatic sorting part "B1," and said rotary type sorting part "C" being mounted on said unhulled-rice sorting part "B2."

Figure 1:
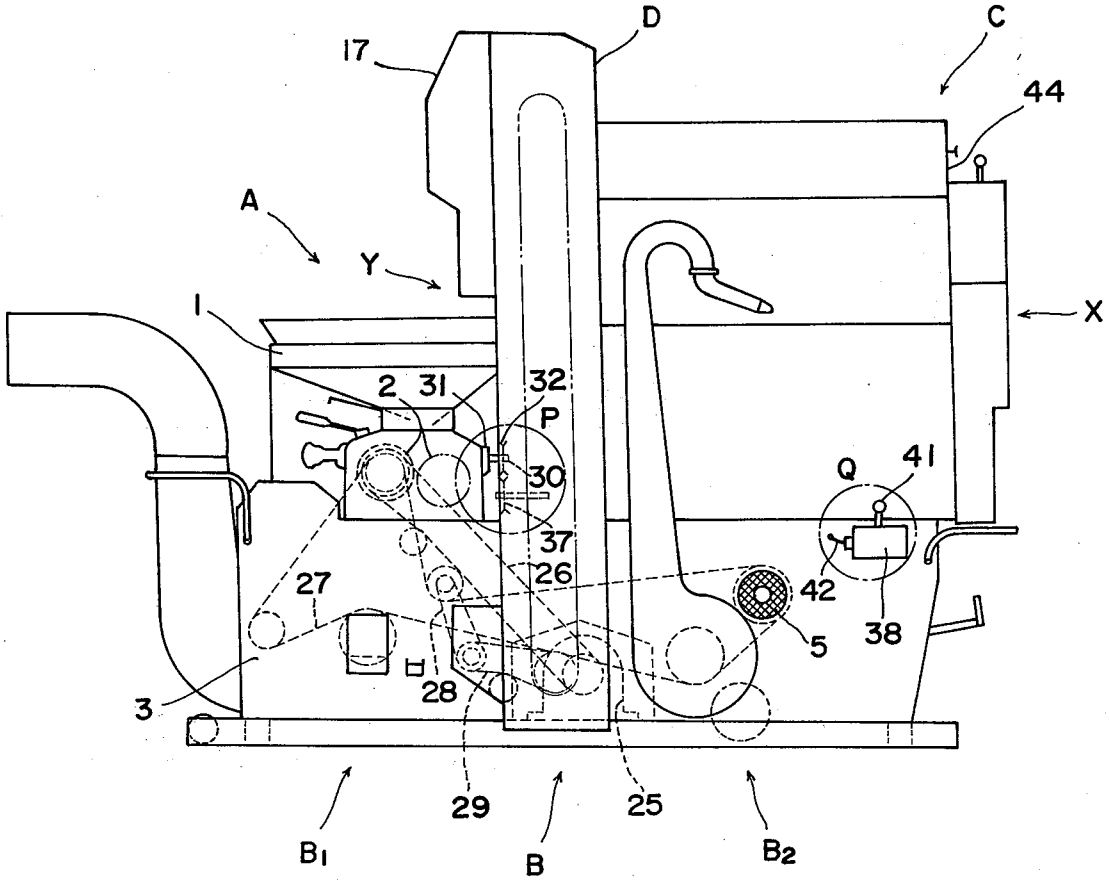
FIG. 1 is a side elevation of a rotary type rice hulling and sorting device as a whole.
Figure 2:
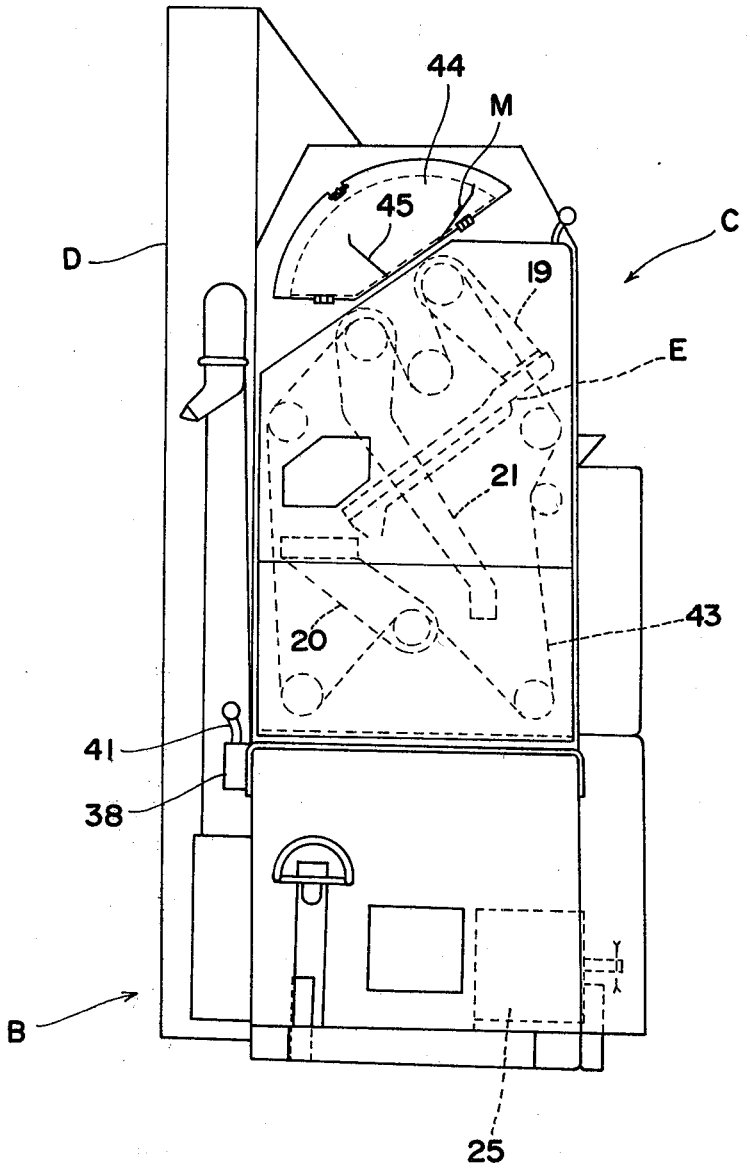
FIG. 2 is a rear view of said device.
Figure 3:
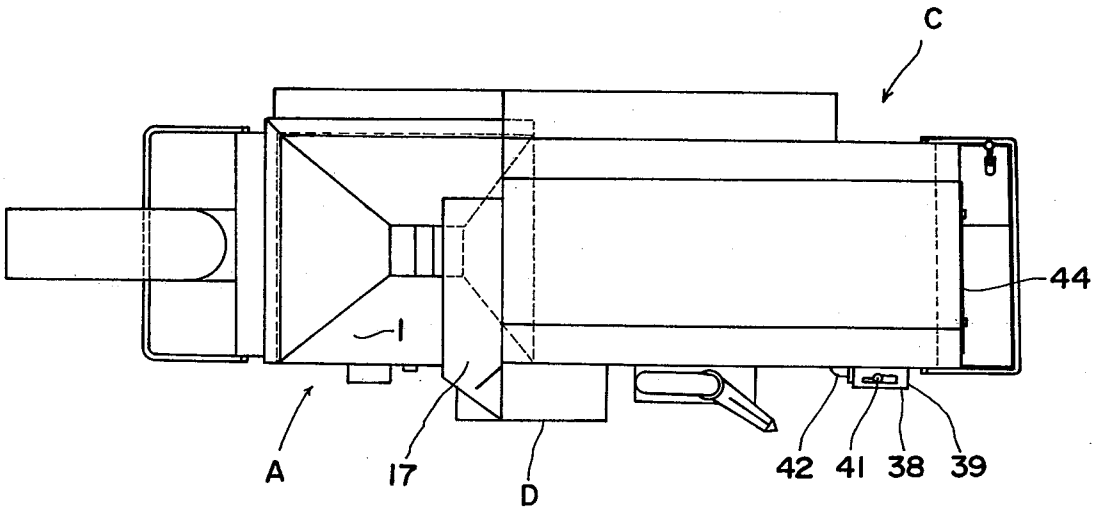
FIG. 3 is a plan view of said device.

A hulled rice-feeding trough 12, finished sorted rice-receiving troughs 13 and rice grain to be resorted-receiving troughs 14 extend in parallel inside said primary sorting cylinders a from the feeding side X to the discharging side Y, each trough 12, 13, 14 including a screw conveyor 15 therein, said rice grain to be resorted-receiving trough 14 being arranged in the lower part side of the direction of rotation of said primary sorting cylinder "a", said finished sorted rice-receiving trough 13 being arranged in the upper part of the direction of rotation of said primary sorting cylinder a, said hulled rice-feeding trough 12 being arranged below said finished sorted rice-receiving trough 13 between said rice grain to be resorted-receiving trough 14 and said finished sorted rice-receiving trough 13, the upper portions of said rice grain to be resorted-receiving trough 14 and said finished sorted rice-receiving trough 13 being opened with an angle of elevation all over the length thereof so that rice grains, which are scooped up by said recesses 10 with the rotation of said primary sorting cylinder a and fall down from the upside along a parabola, may be received just on said troughs 13, 14, and said hulled rice-feeding trough 12 being provided with a feeding port 16 at the feeding side X thereof, and the rice grain-drop position-indicating marks M (shown in FIG. 2) being stuck at some suitable positions on the feeding side X of a slanting surface 13*a* on which the grains are dropped, that is to say the rear side of the body of machine.

17 designates a hulled rice grain-receiving tank arranged at the discharging side Y of said rotary type sorting part "C", that is to say above an unhulled-rice-tank 1, of which the upper part is communicated with the upper part of a grain hoist "D" and of which lower part is communicated with the starting end portion of said hulled rice-feeding trough 12, the lower part of said grain hoist "D" being communicated with said trough for receiving hulled rice grains 7 of said pneumatic sorting part "B".

Besides, a resorted rice grain-receiving trough 18 including a screw conveyor extends inside said secondary sorting cylinder b from the feeding side X to the discharging side Y similarly to the case of said primary sorting cylinder a and is opened with an angle of elevation all over the length thereof similarly to the case of said finished sorted rice-receiving trough 13.

"E" designates a rice grain sorter using longitudinal lines and installed at the feeding side X of said rotary type sorting part "C", of which upper portion is communicated with the end portion of said finished sorted rice-receiving trough 13 through a discharging pipe 19 and of which a lower portion is communicated with the starting end portion of said resorted rice grain-receiving trough 18 installed in said secondary sorting cylinder b through a receiving pipe 20, small ones of sorted rice grains received by said finished sorted rice-receiving trough 13 being removed during the passage thereof toward said resorted rice grain-receiving trough 18.

Furthermore, a resorted rice grain-receiving trough 14 installed in said primary sorting cylinder "a" is communicated with the inside of said secondary sorting cylinder b at the end portion thereof through a feeding pipe 21 of which lower portion is inserted into the feeding side X of said secondary sorting cylinder "b" so that sorted rice grains received by said resorted rice grain-receiving trough 14 may be resorted.

The discharging side Y end of said primary sorting cylinder "a" is disposed over said unhulled-rice tank 1, the discharging side "Y" end of said secondary sorting cylinder b being communicated with said trough for receiving hulled rice grains 7 through a return plate 22 installed aslant, and the end portion of said resorted rice grain-receiving trough 18 being communicated with a flow-down plate 24 installed aslant against said unhulled-rice sorting part B2 through a passage 23.

25 designates a prime mover installed in the space below said pressurized air duct 6, 26 designating a V-belt laid around a pulley of an axis of the fixed hulling roll of a pair of hulling rolls 2 of said hulling part A and a pulley of said prime mover 25, 27 designating a V-belt for interlocking an axis of said fixed hulling roll, an axis of said suction means 3 and axes of screw conveyors installed in said trough for receiving the second grade hulled rice grains 8 and said trough for receiving unhulled-rice grains 9, 28 designating a V-belt for transmitting the power to an axis of a screw conveyor installed in said trough for receiving hulled rice grains 7, 29 designating a V-belt for revolving a bucket belt of said grain hoist D through an axis of a screw conveyor installed in said trough for receiving hulled rice grains 7, and 30 designating a driving shaft for driving said rotary type sorting part "C" which is rearwardly protruded from a gear box 31 in the direction meeting at right angles to an axis of said hulling roll 2 by means of a bevel gear included in said gear box 31 and the like.

One axis of said rotary wheel 11, which supports and revolves said secondary sorting cylinder "b", extends forwardly from the discharging side Y in parallel to said driving shaft 30.

32 designates a split pulley mounted on said driving shaft 30 constructed so as to be able to change the effective diameter thereof by changing the strength of tension of a V-belt laid therearound by means of a spring 33, and 34 designating a tension pulley mounted on a tension arm 35 revolving with said driving shaft 30 as a center, a V-belt for transmitting power to an axis of rotary wheel 36 being laid around a transmission pulley 37 mounted on one axis of said rotary wheel 11 in parallel to said split pulley 32 and said tension pulley 34.

38 designates a speed change box arranged at the left side of the body of machine, which can be freely inclined forwardly and afterwardly with the lower end thereof as the fulcrum and includes a speed change lever 41 detachably mounted at an anchoring portion 40 formed on a guide plate 39, said speed change lever 41 being connected with the tip portion of said tension arm 35 by means of a wire 42 at the suitable position thereof.

Furthermore, 43 designates a V-belt for interlocking an axis of each rotary wheel 11, which supports and revolves said primary sorting cylinder a and said secondary sorting cylinder b at the feeding side X of said rotary type sorting part "C", and axes of screw conveyors of said resorted rice grain-receiving trough 14, said hulled rice-feeding trough 12, said finished sorted rice-receiving trough 13 and said resorted rice grain-receiving trough 18, and 44 designates a transparent body detachably mounted on the body wall inside said primary sorting cylinder a in correspondence to the upper portion thereof at the feeding side X.

Then the operation of a grain sorter of the present invention having the above described structure will be described.

Figure 5:
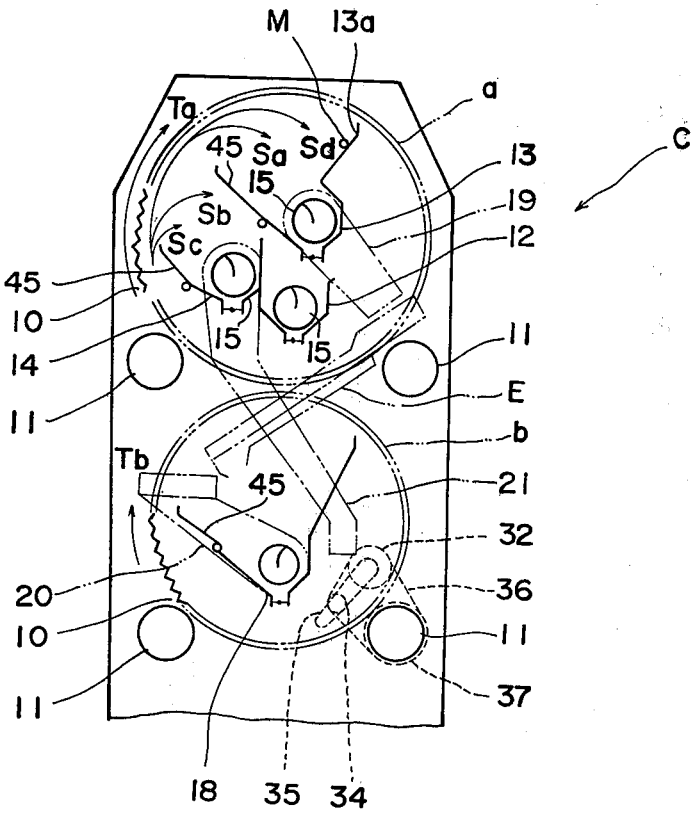
FIG. 5 is a rear view showing the internal structure of said device.
Figure 6:
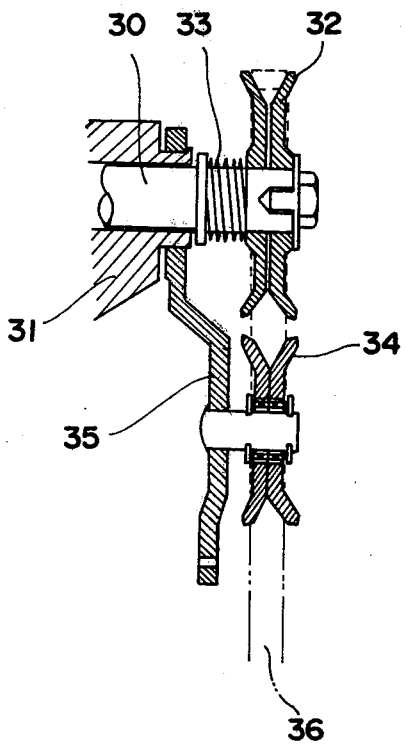
FIG. 6 is an enlarged side elevation of P portion shown in FIG. 1.
Figure 8:
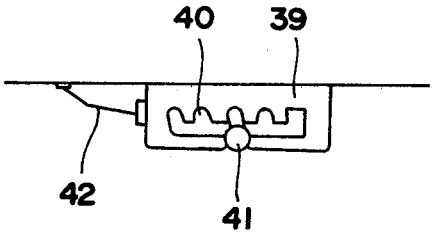
FIG. 8 is an enlarged plan view of Q portion shown in FIG. 1.

The power is transmitted from said prime mover 25 to said hulling part "A", said pneumatic sorting part "B" and said grain hoist "D" through said V-belt 26, 27, 28, 29 and simultaneously revolves said rotary type sorting part C through said V-belt for transmitting power to an axis of rotary wheel 36 to which power is transmitted from said driving shaft 30. Unhulled rice grains fed in said unhulled-rice tank 1 are hulled by a pair of hulling rolls 2 and the pneumatically sorted in said suction duct 4, the second grade rice grains, husks and dusts being removed and collected followed by being transferred to the left side of the body and then being hoisted in said hulled rice grain-receiving tank 17 by means of said grain hoist D. The hoisted hulled rice grains (mixture of unhulled-rice grains and husks) are transferred inside said primary sorting trough "a" rearwardly from the lower portion of said hulled rice grain-receiving tank 17 to said feeding port 16 wherefrom the hulled rice grains are dropped onto the internal surface of said primary sorting cylinder a. The dropped mixture of unhulled-rice grains and husks are scooped up by said recesses 10 with the revolution of said primary sorting cylinder "a" in the direction of an arrow "Ta", being piled up at the time when they are dropped from said feeding port 16 and then gradually shifted toward the direction of revolution of said primary sorting cylinder "a" to travel from the feeding side X to the discharging side "Y". During the transference of the dropped mixture of unhulled-rice grains and husks from the feeding side "X" to the discharging side "Y", they are sorted in dependence upon grain sizes and lubricity thereof, chiefly the unhulled-rice grains being sunk in the lower layer while the husks are risen to the upper layer, and the unhulled-rice grains scooped up by said recesses 10 being upwardly hoisted to the upper side where they escape from said recesses 10 and then drop onto said finished sorted rice-receiving trough 13 or said rice grain to be resorted-receiving trough 14 along a parabola Sa~Sb (shown in FIG. 5). The husks are chiefly risen to the upper layer. But they are relatively strongly caught in said recesses 10 since they have small grain sizes. Even when they are caught in said recesses 10, they can not reach said finished sorted rice-receiving trough 13 and even those, which reached said finished sorted rice-receiving trough 13, drop onto said rice grain to be resorted-receiving trough 14 shown by an arrow Sc because they have large grain sizes while the unhulled-rice grains of small grain sizes are deeply caught in said recesses 10 and difficultly escape therefrom, thereby they are hoisted to the uppermost position, and move through the largest parabolic arc as shown by an arrow Sd, collide against a drop position indicating mark M, and then reach the inside of said finished sorted rice-receiving trough 13 (shown in FIG. 5)

In addition, those husks which were not caught in said recesses 10 and could not reach the inside of said rice grain to be resorted-receiving trough 14, flow in breaking style in the direction of revolution Ta repeatedly to transfer toward the discharging side "Y".

Accordingly, the unhulled-rice grains having the normal grain sizes and small grain sizes are scooped up on said finished sorted rice-receiving trough 13 while the mixture of unhulled-rice containing some husks are scooped up on said rice grain to be resorted-receiving trough 14. The unhulled-rice grains received on said finished sorted rice-receiving trough 13 are rearwardly transferred by means of a screw conveyor 15 to the end portion of said trough 13 wherefrom they go to said rice grain sorter "E" through said discharging pipe 19 where those having small grain sizes escape, the escaping unhulled-rice grains being taken away out of the body while the remaining unhulled-rice grains having the normal grain sizes are flown into said resorted rice grain-receiving trough 18 through said receiving pipe 20. Furthermore, the mixture of unhulled-rice grains received on said rice grain to be resorted-receiving trough 14 are rearwardly transferred similarly to the above described, being fed on the internal surface of the feeding side "X" of said secondary sorting cylinder b through the end portion of said cylinder b and said feeding pipe 21. The fed mixture of unhulled-rice grains is repeatedly subjected to the sorting action, which comprises scooping up it by said recesses 10 revolving in the same direction as shown by an arrow Tb in FIG. 5, in the same way as said primary sorting cylinder "a".

Figure 4:
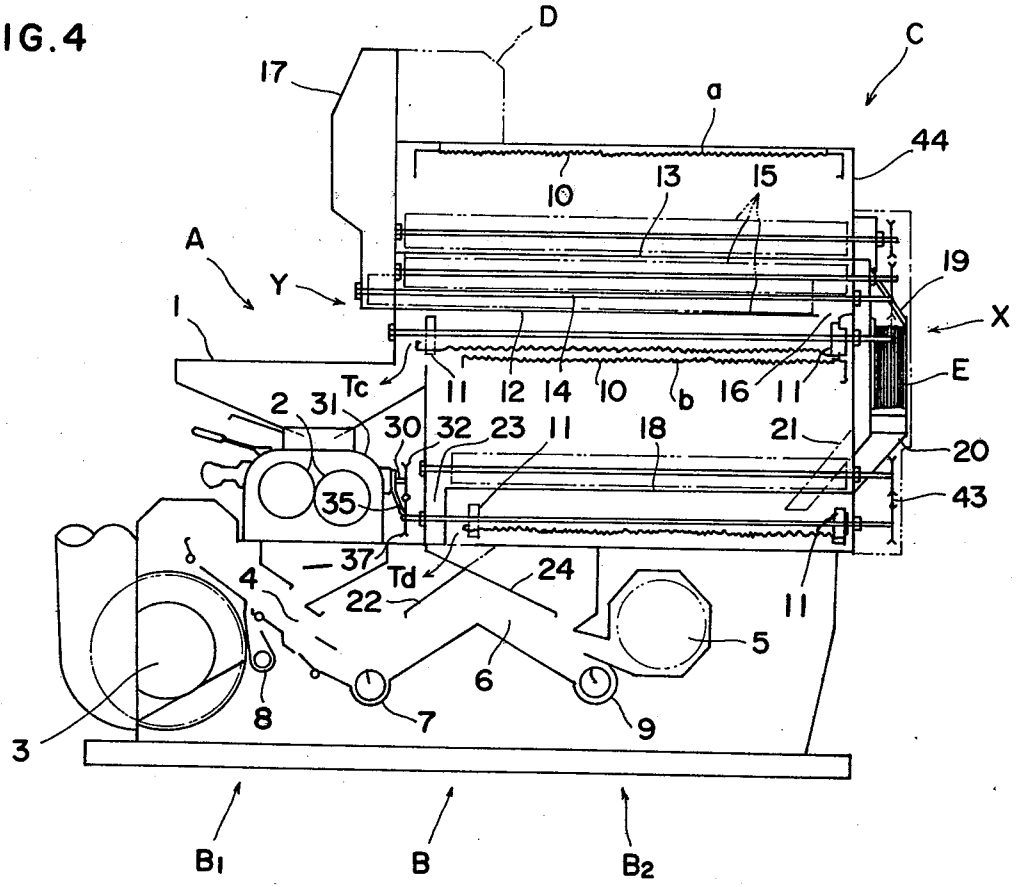
FIG. 4 is a side elevation showing the internal structure of said device.

The scooping up action by said recesses 10 of said primary sorting cylinder a is carried out so that only husks may be returned to said unhulled-rice tank 1 from the discharging side "Y" end of said cylinder a as shown by an arrow Tc in FIG. 4 to be resorted while the scooping up action by said recesses 10 of said secondary sorting cylinder b is carried out so that only unhulled-rice grains may be dropped on said resorted rice grain-receiving trough 18. Thus some husks and the mixture of unhulled-rice grains are discharged from the discharging side "Y" end of said secondary sorting cylinder "b" and then flown down on said return plate 22 as shown by an arrow Td in FIG. 4. After being resorted pneumatically, hulled rice grains are dropped on said trough for receiving hulled rice grains 7 to join with the fresh hulled rice grains while unhulled-rice grains received on said resorted rice grain-receiving trough 18 are transferred to said pressurized air duct 6 through said passage 23 and said flow-down plate 24 where they are pneumatically sorted and then collected in said trough for receiving unhulled-rice grains 9 followed by being transferred sideways and being taken out to the appointed place by means of a thrower.

Although the adjustment by means of a controlling plate 45, of which tilting attitude is freely adjustable, installed at the feeding side of each trough is carried out in order to make the desired unhulled-rice grains and the mixture of husks and unhulled-rice grains drop on said finished sorted rice-receiving trough 13, said rice grain to be resorted-receiving trough 14 and said resorted rice grain-receiving trough 18 as described above, the shapes and sizes of husks and unhulled-rice grains are dependent upon the kinds of rice plants, cultivation control, weather conditions and the like.

In this time, it can be visually found through said transparent body 44 from the rear side of the body of machine that parabolas Sa~Sb and Sd drawn by unhulled-rice grains and a parabola Sc drawn by husks, along which unhulled-rice grains and husks are dropped, are more or less fluctuated when husks having different shapes and sizes are removed and the mixture of husks and unhulled-rice grains are fed into said primary sorting cylinder a of said rotary type sorting part "C". This prevents dropping of the desired unhulled-rice grains and the mixture of husks and unhulled-rice grains on said finished sorted rice-receiving trough 13 and said rice grain to be resorted-receiving trough 14 and thereby also prevents the reduction of sorting accuracy and efficiency. That is to say, unhulled-rice grains having small grain sizes, which had been hoisted to the uppermost position and then been dropped along the largest parabola to collide with said drop position-indicating mark "M", come to be dropped on the upper side or the lower side of said drop position-indicating mark M. When unhulled-rice grains having small grain sizes are dropped on the upper side of said drop position-indicating mark "M", the tension of said V-belt for transmitting power to an axis of rotary wheel 36 is strengthened through said wire 42, said tension pulley 34 and the like by pulling said speed change lever 41, thereby the effective diameter of said split pulley 32 is reduced and as a result the rotational speed of each sorting cylinder "a", "b" being reduced through an axis of said rotary wheel 11, and thus unhulled-rice grains having small grain sizes, which had been dropped on the upper side of said drop position-indicating mark "M", come to be dropped along the smaller parabola to collide with said drop position-indicating mark "M" while when unhulled-rice grains having small grain sizes are dropped on the lower side of said drop position-indicating mark "M", the effective diameter of said split pulley 32 is increased by pushing said speed change lever 41 forwardly, thereby the rotational speed of each sorting cylinder "a", "b" to correct the drop position thereof.

Anchoring members 40 of said speed change lever 41 are arranged at several positions in the longitudinal direction, thereby the rotational speed can be optionally controlled.

As described above in detail, according to the present invention, a driving device of sorting cylinders for use in a rotary type rice hulling and sorting device, comprising a hulling part, a pneumatical sorting part and a rotary type sorting part provided with sorting cylinders rotatably installed therein with one end thereof as the feeding side of rice grains to be sorted and the other end thereof as the discharging side of rice hulled and sorted and having a large number of recesses formed on the internal surface thereof and receiving troughs for taking out the rice grains scooped up by said recesses, said hulling part, said pneumatical sorting part and said rotary type sorting part being integrally constructed and interlocked, and the rotational speed of said sorting cylinders being controllable optionally in no connection with the revolution of said hulling part and said pneumatical sorting part, is provided. Accordingly, in general, the good sorting purity can be maintained by means of a control-plate, of which slanting attitude is freely controllable, installed at the feeding side of receiving troughs but the shapes and sizes of husks and unhulled-rice grains are remarkably dependent upon the kinds of rice plant, cultivation control and weather conditions, thereby the magnitude of a parabola, along which husks and unhulled-rice grains are dropped after being scooped up by said recesses of said revolving sorting cylinder, hoisted to the uppermost position and escaping from said recesses, considerably fluctuates, and as a result said control plate is limited in the control range thereof, that is to say said control plate can not answer to such the fluctuation of the magnitude of a parabola. According to the present invention, the magnitude of a parabola, along which the grains to be sorted are dropped, can be always held constant even though the conditions of the grains to be sorted remarkably fluctuate, thereby the good sorting purity of said rotary type sorting part can be held and the efficiency can be increased with the utmost exhibition of the treating capacity of said hulling part and said pneumatical sorting part since the rotational speed of said sorting cylinders is optionally controlled in no connection with the revolution of said hulling part and said pneumatical sorting part. In addition, the power is transmitted from a driving shaft rearwardly protruding from a gear box of said hulling part to an optional axis of said rotary type sorting part and this optional axis interlocks another axis of said rotary type sorting part. Accordingly, the transmission efficiency to said rotary type sorting part is improved and also the construction is further simplified.

What is claimed is:

1. A driving device of sorting cylinders for use in a rotary type rice hulling and sorting device, comprising: a means for hulling, a pneumatic means for sorting and a means for rotary sorting having at least two sorting cylinders rotatably mounted therein having two ends, with one end of said sorting cylinders being adapted to serve as the feeding side for rice grains to be sorted and the other end of said sorting cylinders being adapted to serve as the discharging side for rice grains which are to be hulled and sorted, the sorting cylinders having a large number of recesses formed on the internal surface thereof, and further having receiving troughs for taking out the rice grains scooped up by said recesses; said means for hulling, said pneumatic means for sorting and said means for rotary sorting being assembled together, the rotational speed of said sorting cylinders being selectively controllable regardless of the rate of revolution of said means for hulling and said pneumatic means for sorting, power from a prime mover being transmitted from a driving shaft of said hulling part to a drive axis of said means for rotary sorting, the drive axis of said means for rotary sorting also being operable to drive other devices;

said means for hulling and said means for rotary sorting being mounted in parallel on said pneumatic means for sorting;

said means for hulling and said pneumatic means for sorting being connectedly driven by a prime mover;

a driving shaft of said means for hulling being connected to a V-belt of said means for rotary sorting through a V-belt for transmitting power;

said means for rotary sorting further comprising a primary sorting cylinder mounted above, and arranged in parallel with, a secondary sorting cylinder;

said primary sorting cylinder being opened to an unhulled rice tank through a discharging end of said primary sorting cylinder;

said pneumatic means for sorting further comprising a trough for receiving hulled rice grains;

said secondary sorting cylinder being opened to said trough for receiving hulled rice grains through a discharging side of said secondary sorting cylinder.

2. A driving device of sorting cylinders for use in a rotary type rice hulling and sorting device, comprising:

a means for hulling, a pneumatic means for sorting and a means for rotary sorting having at least two sorting cylinders rotatably mounted therein having two ends, with one end of said sorting cylinders being adapted to serve as the feeding side for rice grains to be sorted and the other end of said sorting cylinders being adapted to serve as the discharging side for rice grains which are to be hulled and sorted, the sorting cylinders having a large number of recesses formed on the internal surface thereof, and further having receiving troughs for taking out the rice grains scooped up by said recesses; said means for hulling, said pneumatic means for sorting and said means for rotary sorting being assembled together, the rotational speed of said sorting cylinders being selectively controllable regardless of the rate of revolution of said means for hulling and said pneumatic means for sorting, power from a prime mover being transmitted from a driving shaft of said hulling part to a drive axis of said means for rotary sorting, the drive axis of said means for rotary sorting also being operable to drive other devices;

said means for hulling and said means for rotary sorting being mounted on parallel on said pneumatic means for sorting;

said means for hulling and said pneumatic means for sorting being connectedly driven by a prime mover;

said means for rotary sorting further comprising a primary sorting cylinder mounted above, and arranged in parallel with, a secondary sorting cylinder;

said primary sorting cylinder being opened to an unhulled rice tank through a discharging end of said primary sorting cylinder;

said pneumatic means for sorting further comprising a trough for receiving hulled rice grains;

said secondary sorting cylinder being opened to said trough for receiving hulled rice grains through a discharging side of said secondary sorting cylinder.

3. A driving device as claimed in claim 1, further comprising a means for changing tension of said V-belt including a means for varying the effective diameter of said drive axis of said means for rotary sorting, whereby paths of falling rice grains are selectively controllable to improve the sorting operation.

* * * * *